United States Patent [19]

Iyer

[11] Patent Number: 4,709,456

[45] Date of Patent: Dec. 1, 1987

[54] METHOD FOR MAKING A PRESTRESSED COMPOSITE STRUCTURE AND STRUCTURE MADE THEREBY

[75] Inventor: Srinivasa L. Iyer, Rapid City, S. Dak.

[73] Assignee: Stress Steel Co., Inc., Rapid City, S. Dak.

[21] Appl. No.: 836,018

[22] Filed: Mar. 4, 1986

Related U.S. Application Data

[63] Continuation-in-part of Ser. No. 585,824, Mar. 2, 1984.

[51] Int. Cl.[4] ..... B23P 17/04

[52] U.S. Cl. ..... 29/155 R; 14/17; 29/446; 29/426.4; 29/402.04; 29/402.06; 29/402.08; 29/402.09; 29/402.18

[58] Field of Search ..... 52/723, 334, 333, 223 L, 52/223 R; 29/155 R, 155 C, 446, 426.4, 402.04, 402.06, 402.08, 402.09, 402.11, 402.18; 14/17, 73

[56] References Cited

U.S. PATENT DOCUMENTS

| | | | |
|---|---|---|---|
| 2,155,121 | 4/1939 | Finsterwalder | 14/17 X |
| 4,493,177 | 1/1985 | Grossman | 52/223 R X |

FOREIGN PATENT DOCUMENTS

| | | | |
|---|---|---|---|
| 1124075 | 2/1962 | Fed. Rep. of Germany | 14/17 |
| 1226133 | 10/1966 | Fed. Rep. of Germany | 14/17 |
| 2251487 | 5/1974 | Fed. Rep. of Germany | 14/17 |
| 3244035 | 5/1984 | Fed. Rep. of Germany | 14/17 |
| 1048852 | 12/1953 | France | 52/223 R |
| 1209747 | 10/1970 | United Kingdom | 14/17 |
| 896212 | 1/1982 | U.S.S.R. | 52/223 R |

OTHER PUBLICATIONS

Record Bridge Replacement, Civil Engineering-/ASCE.

*Primary Examiner*—Howard N. Goldberg
*Assistant Examiner*—Joseph M. Gorski
*Attorney, Agent, or Firm*—Merchant, Gould, Smith, Edell, Welter & Schmidt

[57] ABSTRACT

A prestressed composite structure (48) and method for making same. The ferroconcrete prestressed structure (48) includes a tensile member (10) which includes a steel I-beam (12) which has on its upper flange (16) a plurality of shear connectors (14). The beam (12) is bent or bowed by pushing on the center region of the beam (12) with a screw jack (28) or the like while forces are applied to the first and second ends (21) and (23), respectively, of the beam (12). The end forces can simply be due to the weight of the beam (12) or can be supplemented, in one embodiment, through the use of threaded rods (32) and (38) which interconnect the beam (12) and a dummy beam (26). The bowed beam (12) has a convex surface (42) on which a compressive layer (46) is attached. Preferably, a concrete layer (46) is utilized with the concrete bonding to an upper flange (16) of the beam (12) and the concrete layer (46) encasing or enveloping the shear connectors (14) to make the composite unit (48) act as a single structural device. Once the concrete layer (46) has sufficiently cured, the bending moment created by the screw jack (28) and rods (32) and (38) is removed and the resulting composite structure (48) is prestressed and is therefore better able to withstand dead and live loading.

20 Claims, 14 Drawing Figures

FIG. 1
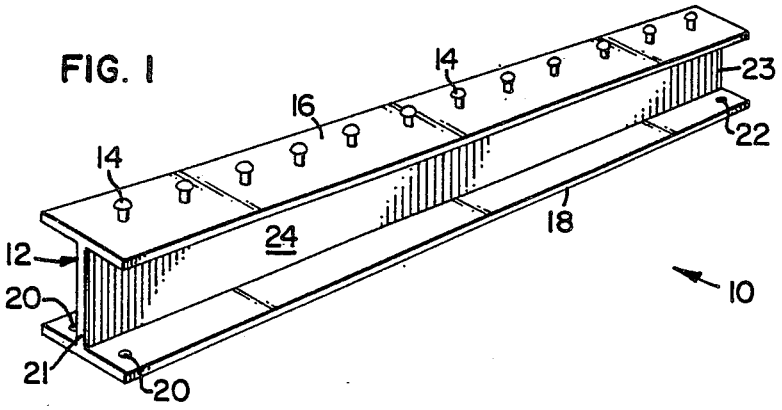
FIG. 2
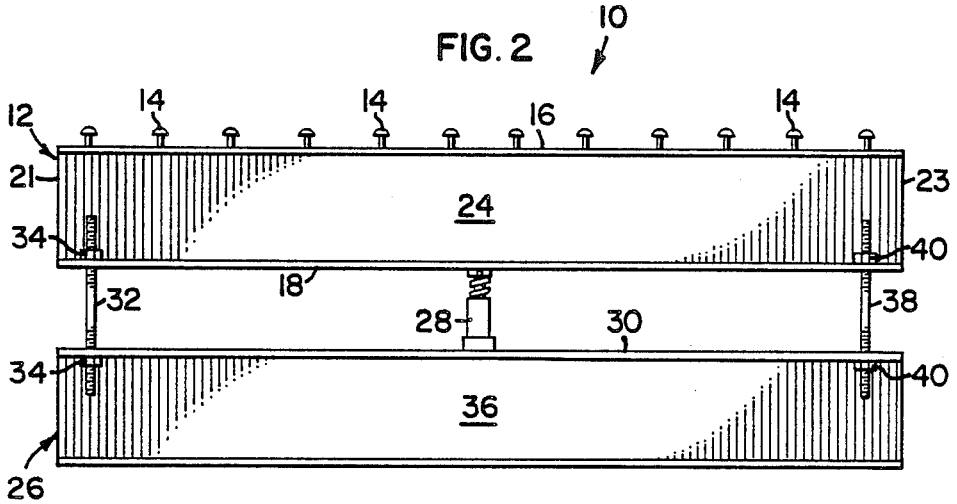
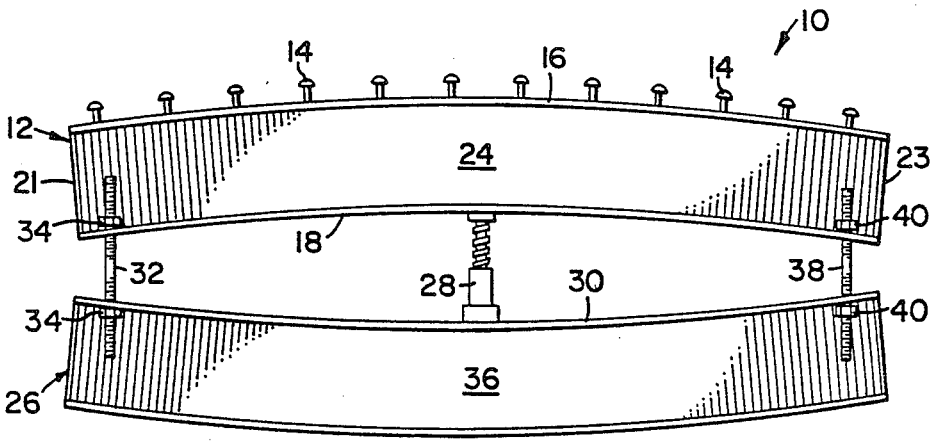
FIG. 3

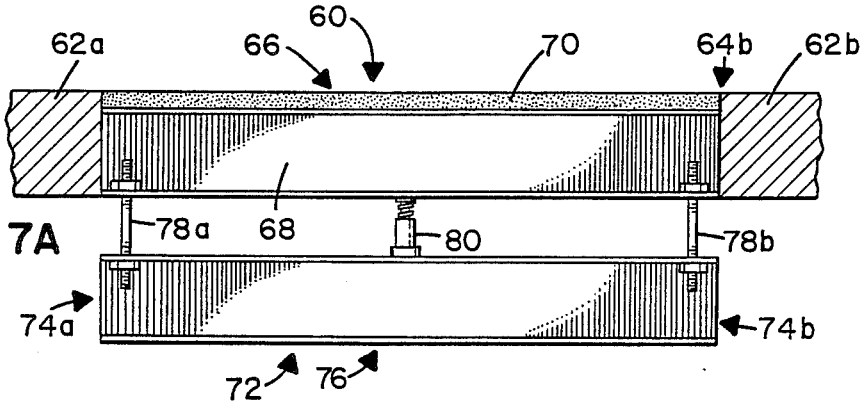
FIG. 7A
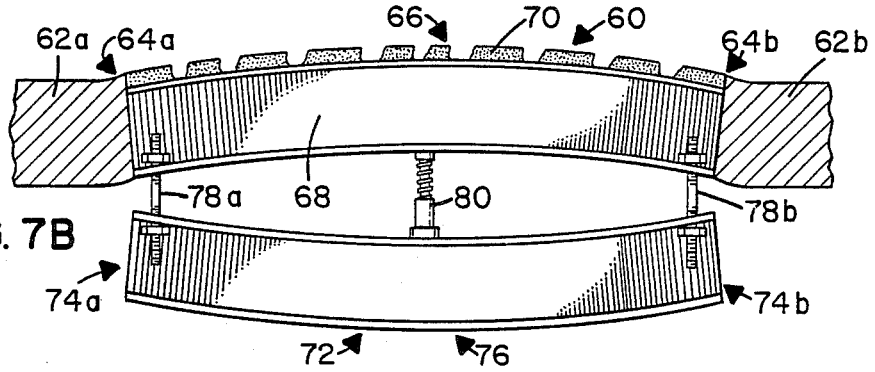
FIG. 7B
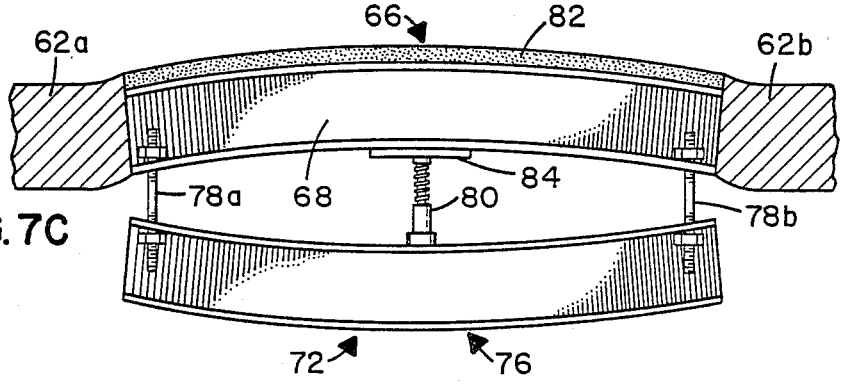
FIG. 7C
FIG. 7D
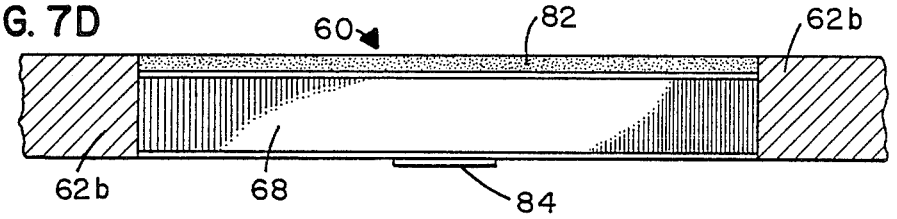

METHOD FOR MAKING A PRESTRESSED COMPOSITE STRUCTURE AND STRUCTURE MADE THEREBY

FIELD OF THE INVENTION

This patent application is a continuation-in-part of application Ser. No. 585,824, filed Mar. 2, 1984, now abandoned.

This invention relates generally to prestressed structures, and more particularly to prestressed composite structures and methods for making prestressed composite structures.

BACKGROUND OF THE INVENTION

The present invention relates generally to composite structures, those comprising two or more dissimilar materials, and such structures are well-known and in widespread use. One common type of composite structure is a ferroconcrete girder made from one or more steel beams with a concrete overlayment. The steel portion of the composite structure is situated toward the bottom of the structure whereas the concrete lies atop the steel. This arrangement takes advantage of the structural properties of the steel and concrete and makes for a cost-effective structure which has an adequate factor of safety.

Further with regard to ferroconcrete composite structures, the steel portion of the structure is commonly in the form of an "I" beam and the concrete is cast upon the I-beam with the two materials forming a homogeneous or integral unit once the concrete has cured. The steel forms a "tensile layer" whereas the concrete forms a "compressive layer." That is, it is desirable to fabricate the ferroconcrete structure such that most of the concrete lies above the neutral plane of the structure so that the concrete is substantially under compression due to the dead and live loads on the composite structure. On the other hand, the steel is located primarily below the neutral plane so that the steel can absorb the tensile stresses which are incurred by the composite structure when the structure is subjected to the dead and live loads. As well known to those skilled in the art, the I-beam of a ferroconcrete composite structure is not typically subjected solely to tensile stresses, but the phrase "tensile layer" will be used to refer to the I-beam or like elements in other composite structures for the sake of brevity.

The foregoing is quite well known to those skilled in the art, and the particular arrangement of steel and concrete in a ferroconcrete composite structure is chosen primarily due to the weakness of concrete in tension and due to the fact that concrete makes a superior overlayment and is sufficiently strong in compression.

A composite structure of the type discussed above should be distinguished from reinforced concrete and the like. Reinforced concrete is comprised primarily of concrete but includes one or more slender members typically made of steel which are held in tension by the concrete. That is, the concrete is compressed by the steel cable or rods whereas the rods are held in tension by the concrete, and this compression of the concrete tends to overcome any deliterious effects caused by placing the concrete in tension.

In contrast to reinforced concrete, the present invention relates to a true composite structure such as a ferroconcrete girder. In a composite structure of the type contemplated by the present invention, the steel reinforcing layer is capable of withstanding bending stresses and does not primarily function to place a portion of the concrete in compression as was the case in reinforced concrete structures.

As well known to those skilled in the art, composite structures are not limited to ferroconcrete girders. Ferroconcrete composite structures can be used for other structural members and the present invention is not limited to a ferroconcrete girder, i.e. a horizontal main structural member that supports vertical loads.

Furthermore, other materials can be used for fabricating composite structures and are contemplated by the present invention. Wood and laminated wood can be used for a tensile layer, for example, and, in fact, wood can also be used for the compressive layer. The present invention is not limited to any particular material or combination of materials as is clear to those skilled in the art of the fabrication of structural members. However, for the sake of brevity, and only as an example, the present description of the prior art and the detailed description of the invention will be limited to ferroconcrete structues.

As noted above, the present invention is related to composite structures, but more particularly it is related to "prestressed" composite structures. It is well known in the art to "prestress" a composite structure to take better advantage of the properties of the materials. For example, it is well known to prestress a steel beam to produce a convex surface and a concave surface in the beam and then cast the concrete layer on the convex surface of the beam. Once the concrete has cured, the bending moment is removed and the concrete layer is subjected to compression while the uppermost layer or flange of the steel beam is subjected to tension and the lower flange of the beam is held in compression. The concrete layer, or "compressive" layer, in effect "locks in" the stresses in the steel beam formerly induced by the bending moment. With the upper portion of the steel beam in tension and the lower portion in compression the beam is prestressed and is better able to accommodate dead and live loads. That is, the concrete which forms the compressive layer absorbs a portion of the dead and live loads as it compresses, but the concrete also serves to maintain the prestress in the steel beam so that it can better absorb the tensile stresses at the bottom flange induced by the dead and live loads. The end result is that the cross-section of the steel beam can be reduced while at the same time the applicable factor of safety is met. Clearly, this reduction in the cross-section of the steel beam results in a considerable cost savings. Alternatively, the cross-section of the steel beam can be maintained and the prestressed composite structure can withstand larger loads than a visually similar structure which has not been prestressed.

As well known in the art of ferroconcrete fabrication, the compressive and tensile layers, the concrete slab and steel beam, must be bound together so as to act as a single integral structural unit. This can be accomplished either by securely bonding the concrete to the steel beam or by using a shear connector of some type. Shear connectors are also well known in the art, one type being a stud which projects from the upper flange of the steel beam and around which the concrete is cast. Shear stresses are transmitted through the studs from one layer of the composite structure to the other. Other types of shear connectors are contemplated by the present invention, such as a spiral device which is welded to the top flange of the beam.

Various methods for making prestressed composite structures have been proposed. One method for making composite structures is represented by the method shown in U.S. Pat. No. 4,006,523, issued to Mauquoy. In this method, transmission elements are securely attached to the bottom flange of the steel beam at opposite ends of the beam. High strength wires or cables pull the transmission elements toward one amother to bend the beam and encasing concrete is cast around the beam, transmission elements and cable.

Several shortcomings are perceived with this method for prestressing a composite structure. First, the transmission elements must be securely attached to the bottom portion of the beam using, for example, a welding process. This step is time consuming and expensive. Secondly, the cables and transmission elements must produce very large forces in order to sufficiently bend the beam prior to pouring the encasing concrete. This is due to the limited moment arm that the transmission elements provide. The very large forces induced in the cable and transmission elements poses a safety problem.

The method as shown in U.S. Pat. No. 4,006,523 also requires that there be sufficient clearance below the beam for the welding and encasing processes. In some cases, this clearance is not available such as in bridge construction where overhead clearance is critical.

Additionally, this method of prestressing a composite structure would be difficult if not impossible to implement with preexisting structures. For example, on occasion it is desirable to increase the load-carrying capability of a girder which have been in operation for some time. It would be desirable to prestress the girder by removing and recasting the concrete without having to remove the girder from the bridge. The method represented by the method shown in U.S. Pat. No. 4,006,523 clearly suffers from shortcomings when preexisting structures are involved: the clearance problem discussed above might preclude the use of this method altogether, and it might be very difficult in some cases to adequately access the bottom flange of the beam to weld the transmission elements in place.

Still another prestressing method that has been suggested includes simply supporting the steel beam at its ends, and allowing the center portion of the beam to sag between the support points. Forms are attached to the beam and concrete is cast such that it is in contact with the bottom flange of the beam. The weight of the form and the concrete causes the beam to sag even further. The bending moment created by the weight of the beam, form and concrete induces a prestress in the beam and the composite structure.

When the concrete has sufficiently cured, the composite structure is flipped or rotated so that the concrete is on the top side of the composite structure, the concrete forming an overlayment for the structure. The concrete locks the prestress into the structure and the dead and live loads applied to the structure are more easily handled. That is, the dead and live loads cause the concrete to compress and the steel beam to bend in a direction opposite to the sag or bend which was initially preset into the composite structure. The prestresses which were induced and locked into the steel beam are opposite to the stresses induced in the beam due to the dead and live loads and therefore the prestresses act to counter the stresses due to the loads on the composite structure and particularly on the steel beam.

This method for making a prestressed composite structure also possesses several shortcomings. As noted above, once the concrete has cured, the composite structure must be rotated prior to use. Even if such composite structures are fabricated in a manufacturing plant, this flipping procedure is difficult and expensive since the composite structure is typically quite massive and unwieldy.

Furthermore, this method of casting the concrete on the underside of the inverted beam cannot easily be used with pre-existing structures. For example, if this method were attempted to be used to increase the load carrying capability of a bridge girder, the bridge girder would have to be removed from the bridge and reworked or prestressed. The concrete casting process clearly would not be accomplished while the beam is in place in the bridge structure since the resulting composite structure could not be flipped without removing it from the bridge.

The present invention is directed to the shortcomings noted above with respect to the prior art methods. The present invention is a method for prestressing a composite structure which does not require the attachment of transmission elements or the like to the tensile layer, the steel beam in a ferroconcrete composite structure. Furthermore, the present invention does not require that the resulting composite structure be flipped following the engagement of the compressive layer with the tensile layer. On the contrary, the present method is quite simple to use and, in fact, can be utilized to rehabilitate preexisting structures without requiring the removal of the structures or structural components from the main body of the structure. In other words, the method can be used in situ.

SUMMARY OF THE INVENTION

In its broadest form, the present invention is primarily directed to a method for making a prestressed composite structure, wherein the structure includes a tensile layer and a compressive layer. The method includes the steps of applying a center force to the tensile layer near the center of the tensile layer with a force applying apparatus in operative contact with the tensile layer. A first end force is applied to the tensile layer near a first end region of the tensile layer, wherein the first end force is in a direction opposite to the center force on the tensile layer. A second end force is applied to a second end region of the tensile layer and in the same direction as the first end force. The forces, the center force and the first and second end forces, combine to form a bending moment which elastically deforms the tensile layer, creating a tensile layer convex surface and a tensile layer concave surface opposite the convex surface.

A compressive layer is operatively engaged with the convex surface of the tensile layer, and the bending moment is removed. The composite structure, made up of the tensile layer and compressive layer, is thereby prestressed with the compressive layer locking in the stresses induced by the bending moment.

A preferred method also includes applying the end forces by supporting the center region of the tensile layer by a center force applying apparatus and allowing the weight of the first end of the tensile layer and the weight of the second end of the tensile layer to contribute to the bending moment.

A preferred method also includes utilizing first and second end forces applying apparatus to exert end forces on the tensile layer to bow the tensile layer.

Still another preferred method includes positioning a dummy layer proximate to the tensile layer and interconnecting the ends of the tensile layer and the dummy layer. In one preferred method, a center force applying apparatus also acts on the dummy beam and the center region of the tensile layer to bow the center region upward while the ends of the tensile layer are restrained by the dummy layer.

Another preferred method includes engaging the compressive layer by casting a layer of concrete in operative contact with the convex surface of the bowed tensile layer, allowing the layer of concrete to cure to a degree sufficient to substantially withstand the compressive stress which is created in the compressive layer following the removal of the bending moment.

Preferably, the tensile layer includes a steel beam. Similarly, preferably the dummy layer includes a steel beam. I-beams or built-up beams are, of course, useful for these purposes.

The present invention also includes a prestressed composite structure made according to the methods discussed above.

Still another method according to the invention is for rehabilitating bridge girders. One preferred rehabilitating method involves using a crane to bend a girder to crack its concrete layer and induce a prestress. Other preferred methods involve use of a dummy beam to bend the girder.

BRIEF DESCRIPTION OF THE DRAWING

FIG. 1 is a perspective view of a tensile member for use in the present invention including a steel I-beam.

FIG. 2 is a side elevational view of the tensile member of FIG. 1 and a dummy beam spaced therefrom with force exerting apparatus between the beams.

FIG. 3 is a side elevational view of the force applying apparatus in use causing the tensile member to elastically bend.

Figure 4:
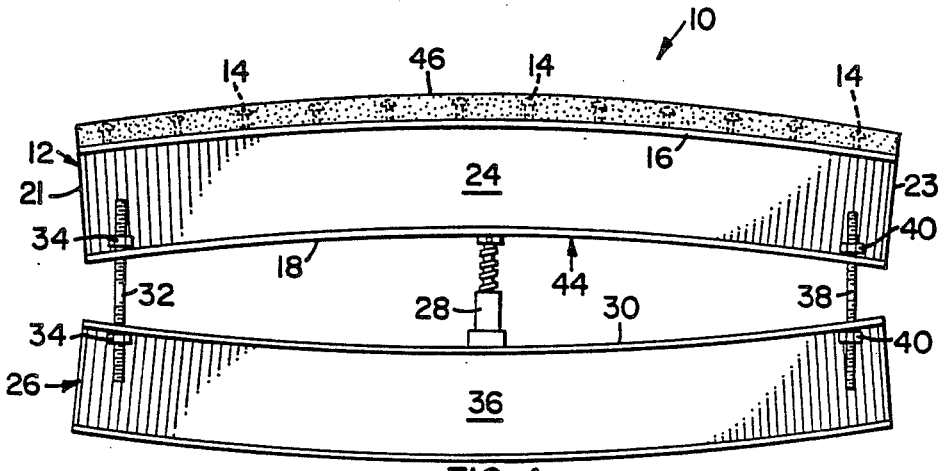
FIG. 4 is a side elevational view of the bowed tensile member of FIG. 3 including a layer of concrete on its convex surface.

FIGS. *7a–7d* show side elevational views of an existing bridge girder being rehabilitated, wherein a dummy beam is positioned below the girder.

FIGS. *8a–8d* show side elevational views of an existing girder being rehabilitated, wherein a dummy beam is positioned above the girder.

DETAILED DESCRIPTION OF THE INVENTION

As noted above, the present invention is primarily directed to a method for making a prestressed composite structure. The following description focuses on the fabrication of a ferroconcrete girder which includes a steel I-beam and a concrete slab. As noted above, the invention is not limited to these particular materials as is clear to those skilled in the art. Furthermore, the invention is not limited to the fabrication of a prestressed composite structure utilizing the precise technique discussed below, the technique presented below being merely a preferred embodiment of the invention.

The first step of the preferred method is the choice of an appropriate "tensile member" for the prestressed composite structure. As noted above, it is recognized that the tensile member is subjected to compressive stresses during the prestressing and use: the label "tensile member" or the like is utilized for the sake or brevity. In the drawing, wherein like reference numerals represent like parts throughout the several views, FIG. 1 shows such a tensile member or layer 10 which includes an I-beam 12 having a plurality of shear connectors 14 attached to an upper flange 16 of the I-beam 12. As well known to those skilled in the art, beam 12 can be any material which can withstand the prestress and the stresses induced by the live and dead loads. For example, the beam 12 could be a built-up beam or could be made of wood.

Figure 6:
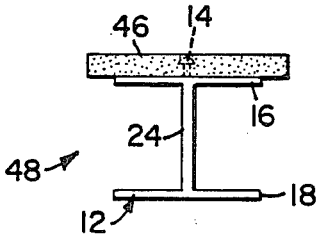
FIG. 6 shows an end elevational view of the prestressed composite structure of FIG. 5.
Figure 8A:
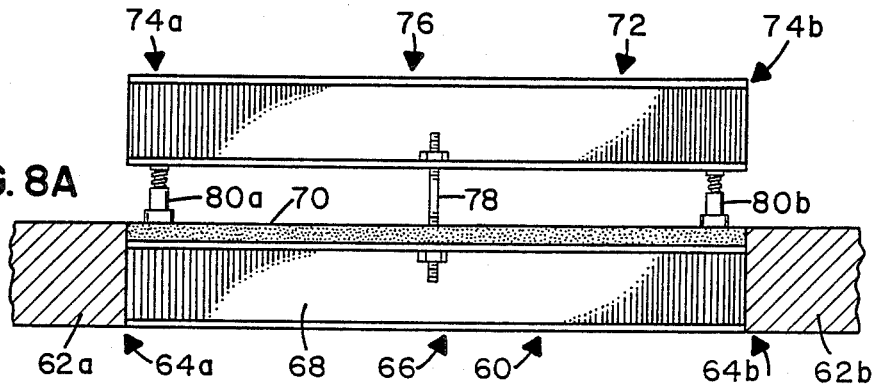
Figure 8B:
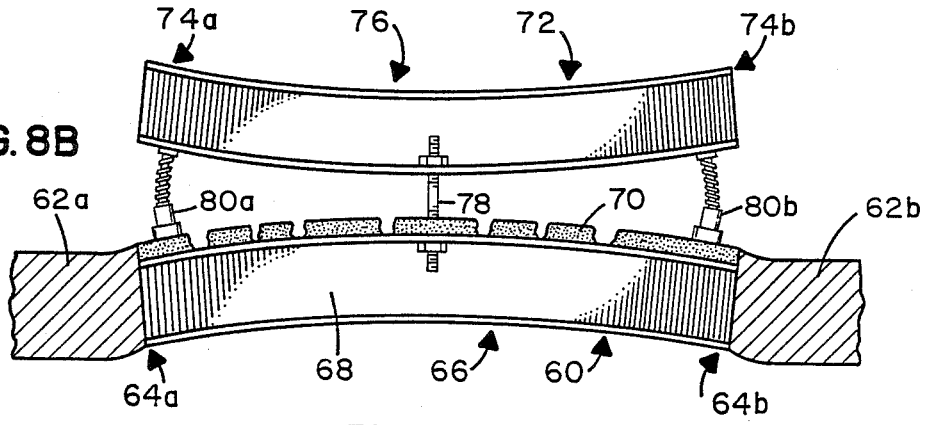
Figure 8C:
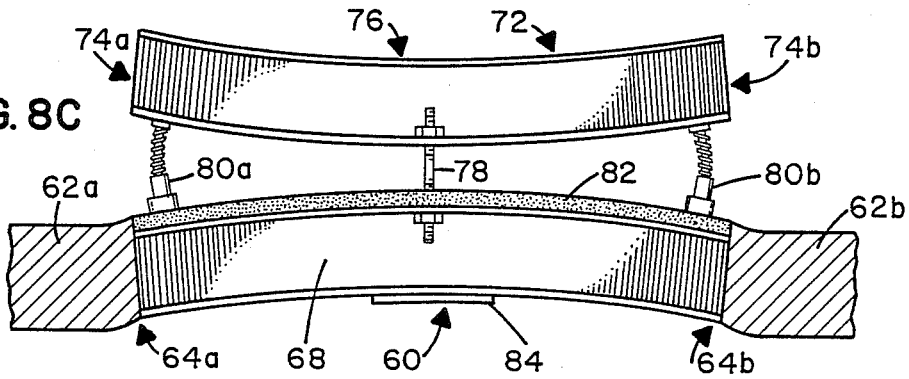
Figure 8D:
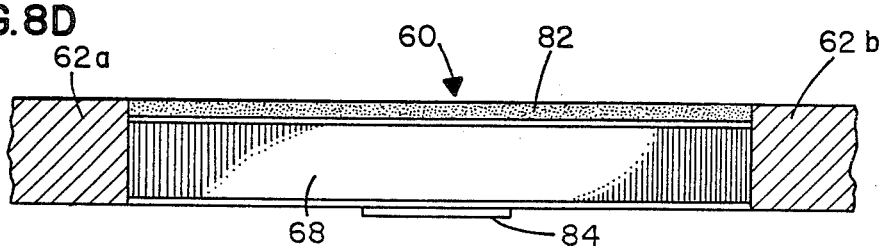

As noted above, the shear connectors 14 function to transmit shear stress from the structural beam 12 to the compressive layer which is operatively engaged to the top flange 16 of the beam 12. The shear connectors 14 are preferably non-threaded studs having heads which are welded to the top flange 16 of the beam 12 and extend substantially perpendicular thereto, as shown in FIG. 6. The shear connectors 14 are preferably spaced according to the shear force distribution in the structure as well known to those skilled in the art. Furthermore, the shear connectors 14 can be of any type, including threaded studs or threaded studs having heads.

A bottom flange 18 of the structural I-beam 12 forms a pair of holes 20 at a first end 21 of the tensile member 10 and likewise forms a pair of holes 22 at a second end 23 of the tensile member 10. The holes 20 and 22 are preferably symmetrically disposed on opposite sides of a web 24 which interconnects the top flange 16 and the bottom flange 18.

The first step of the preferred method is, in a sense, the selection of an appropriate tensile member.

FIG. 2 illustrates the next step of a preferred method of the present invention. A dummy beam 26, preferably an I-beam having similar physical characteristics to the structural beam 12, is disposed so that it is substantially parallel to the structural beam 12 and displaced from the structural beam 12 by a predetermined distance. A screw jack 28 is placed into contact with the bottom flange 18 of the structural beam 12 and a top flange 30 of the dummy beam 26. Preferably, the screw jack 28 is substantially centered between the first end 21 and the second end 23 of the tensile member 10 for reasons discussed below.

FIG. 2 also illustrates the preferred technique of interconnecting the first end 21 of the tensile member 10 to the dummy beam using a pair of first rods 32. The first rods 32 are preferably threaded and are operatively engaged by first nuts 34. The first rods 32 are symmetrically disposed about the web 24 of the structural beam 12, and likewise are symmetrically disposed about a web 36 of the dummy beam 26.

Similarly, second rods 38 engage the second end holes 22 of the bottom flange 18 of the structural beam 12 and are connected to the top flange 30 of the dummy beam 26 in like fashion. Second nuts 40 engage the second rods 38 and the second rods 38 are symmetrical with respect to the webs 24 and 36.

It will be understood by those skilled in the art that the screw jack 28 could be replaced by any similarly functioning device, for example a hydraulic jack or the like. Furthermore, the rods 32 and 38 could be replaced by other means for interconnecting the flanges 18 and 30.

FIG. 3 illustrates the next step of a preferred method, the use of the jack 28 and the rods 32 and 38 to bend the tensile member 10. Preferably, the screw jack 28 is expanded so as to increase the distance between the center region of the bottom flange 18 and the top flange 30 of the dummy beam 36. Also, preferably, the nuts 34 and 40 are rotated with respect to rods 32 and 38, respectively, so as to draw the first and second ends 21 and 23, respectively, of the structural beam 12 toward the dummy beam 36. The end result is to bow or bend the structural beam 12 so as to create a concave surface on the jack side of the bottom flange 18 of the beam 12 and a convex surface on the shear connector side of the top flange 16 of the beam 12. Clearly, as also well known to those skilled in the art, the top flange 16 is thus placed substantially in tension whereas the bottom flange 18 is subjected to a compressive stress.

As is quite clear to those skilled in the art, it is not necessary that the screw jack 28 be expanded while the rods 32 and 38 are utilized to draw the ends of the structural beam 12 downward. Alternatively, the ends could be simply held in position by the rods 32 and 38 while the center region of the beam 12 is pushed upwards. Similarly, the screw jack 28 could simply be used to hold the center region at a fixed distance from the dummy beam 26 while the ends 21 and 23 are drawn downward. The net effect in each of these cases is to generate a bending moment on the beam 12, the beam 12 being elastically deformed to create a convex surface 42 and a concave surface 44 on the structural beam 12.

Although the use of the dummy beam 26 is preferred, it is not necessary that a dummy beam be utilized. That is, the screw jack 28 and the rods 32 and 38 could be directly put into contact with any relatively unyielding structure or surface. It is only necessary that the anchoring structure or surface be strong enough to withstand the large compressive stresses generated by the screw jack 28 and the large tensile stresses generated by the rods 32 and 38 when these components are employed to bend the structural beam 12.

The amount of bend or bow in the beam 12 depends on the amount of prestress which is desired. Those skilled in the art recognize that the more that the beam 12 is bent, the more the upper flange 16 is put into tension and the more that the lower flange 18 is put into compression. The properties of the concrete slab (discussed below) and the shear connectors 14 must be taken into consideration since these elements of the composite structure serve to lock in or hold the prestress on the beam 12. A very large prestress in the beam 12 necessitates very strong shear connectors 14 and a compressive layer (discussed below) that can withstand very large compressive stress. On the other hand, as clear to those skilled in the art, shear connectors may be unnecessry if the bond between the tensile layer and the compressive layer is quite strong.

It should also be noted that the screw jack 28 could be replaced by an apparatus which pulls on the center region of the beam 12 from above the top flange 16. For example, a crane (not shown) could be used to pull on the center region of the beam as the ends of the beam are restrained. Similarly, the end forces which pull on the first and second ends 21 and 23 of the tensile member 10 could be exerted by the use of apparatus which push downward on the upper flange 16 of the beam 12. For example, large weights could be placed in the ends 21 and 23 to bow the beam 12 as it is centrally supported by the screw jack 28. Alternatively, the weight of the beam itself, coupled with the weight of the compressive layer, is sufficient to adequately prestress the beam 12 in some cases.

FIG. 4 shows a side elevational view of the prestressed tensile member 10 illustrating the next step of the preferred method of the present invention. Concrete is poured into a form (not shown) which is operatively engaged to the top flange 16 of the beam 12 and upon curing a concrete layer 46 is formed. The concrete layer 46 adhesively engages the top flange 16 and envelopes the shear connectors 14 so that shear stresses are transmitted between the concrete layer 46, the compressive layer, and the structural beam 12, the tensile layer of the composite structure. As noted above, the concrete layer 46 "locks" the prestress into the beam 12 once the dummy beam 26, jack 28 ad rods 32 and 38 are removed, thereby removing the applied bending moment from the composite structure.

Clearly, the concrete layer 46 can be "Portland" cement concrete or any other material that can be formed and cured with comparable compressive strength, e.g., polymer concrete, latex-modified concrete, or epoxy-modified concrete. Also, as noted above, those skilled in the art will appreciate that the compressive layer need not be comprised of concrete at all and can in fact be any material which can withstand the compressive stresses generated by the tensile layer.

Figure 5:
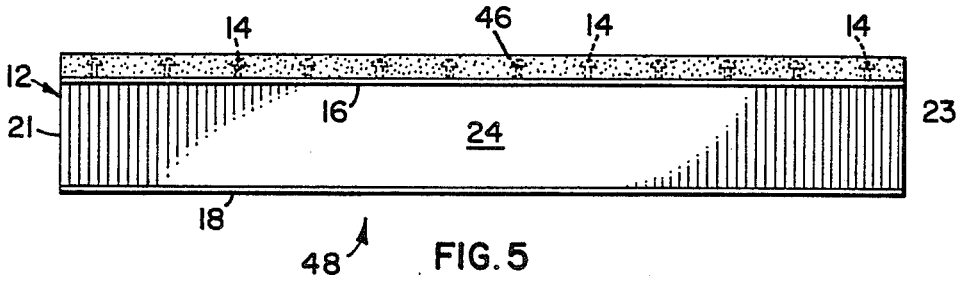
FIG. 5 shows a side elevational view of the completed prestressed composite structure following the removal of the bending moment.

FIG. 5 shows a completed prestressed composite structure 48 following the removal of the bending moment induced by the dummy beam 26, the screw jack 28 and the rods 32 and 38 and attendant parts. The prestressed composite structure 48 includes a compressive layer 46, a concrete layer in the preferred method, and a tensile layer or member 10 comprised primarily of the steel beam 12 in the peferred embodiment.

FIG. 6 shows an end elevational view of the prestressed ferroconcrete structure 48 showing the preferred placement of the shear connectors 14, symmetrical with respect to the top flange 16 of the beam 12. It should be noted that the prestressed structure 48 includes a single I-beam but that the method of the present invention is not so limited. In fact, the prestressed composite structure could have two or more tensile members in a given structure fabricated according to the present invention.

It should also be noted that the concrete layer 46 is typically allowed to cure until its ultimate compressive strength has reached a safe stress prior to removing the bending moment by removing the temporary supports. Those skilled in the art will recognize that the properties of the material which comprises the compressive layer establish the "safe stress" in a particular embodiment. Those skilled in the art will also recognize that in many applications the shear connectors 14 will protrude through the concrete layer 46. The present invention is clearly not limited to the specific embodiment shown in the drawing.

It should further be noted that the present method is applicable to preexisting structures. For example, a bridge girder can be rehabilitated by pulling upward on the center region of the girder through the use of a crane with the ends of the girder bolted down on the foundation or other attachment point, thus causing the concrete to crack typically in several places. The concrete can then be entirely removed, shear connectors attached if necessary, and a new slab cast, or the cracks can be filled with a high-strength concrete such as polymer concrete to complete the compressive overlayment layer. Once the compressive layer has sufficiently cured, the upward force generated by the crane can be removed and the prestressed composite structure can thereafter carry greater loads than the former girder which was not prestressed.

A preferred rehabilitation method is illustrated in FIGS. 7 and 8. Referring in particular to FIG. 7, an existing composite (e.g., ferroconcrete) girder 60 spans between stationary attachment points 62a and 62b (e.g., other girders or ground areas). The ends 64a and 64b of girder 60 are securely bolted or otherwise connected to the stationary areas 62. Girder 60 also has a middle region 66, and includes a tensile layer or I-beam 68 and a compressive layer or concrete layer 70.

Positioned beneath girder 60 is a dummy beam 72 having ends 74a and 74b and a middle region 76. End 74a of dummy beam 76 is tied to end 64a of beam 68 preferably through the use of a threaded rod 78a. End 74b of beam 72 is likewise connected to end 64b of beam 68 preferably through the use of a threaded rod 78b. Finally, a jack 80 separates the middle regions 76 and 66 of the beams 72 and 60, respectively.

As shown in FIG. 7B, the jack 80 is extended to force the beam's middle regions 66 and 76 apart, thus bending girder 60 such that concrete layer 70 is subjected to a tensile stress sufficient to cause it to crack. Rods 78 hold the beams' ends 74 and 64 together.

Referring to FIG. 7C, the concrete layer 70 can then be removed and replaced, or the cracks in the concrete can be filled with a high strength concrete. In either case, shear connectors can be added if necessary. The new or reinforced concrete layer is assigned reference number 82 in FIGS. 7 and 8.

Additional support plates 84, illustrated in FIGS. 7C and 7D, can be bolted or bonded to the concave side of beam 68 to assist the concrete layer in maintaining the beam's prestress. The plates 84 can be high strength steel or graphite-reinforced epoxy, for example.

Once the new concrete layer 82 cures sufficiently, whether it be an entirely new layer or a combination of old concrete and high strength crack filler, the girder 60 is fully rehabilitated (prestressed) and the dummy beam 72 and its attendant parts can be removed.

FIG. 8 illustrates another preferred rehabilitation process according to the invention. The illustrated method is substantially identical to the method shown in FIG. 7 except for the fact that the dummy beam 72 is located atop girder 60 in FIG. 8. The middle regions 76 and 66 of the beams 72 and 68, respectively, are tied together by threaded rod 78; and ends 64 and 74 are forced apart by jacks 80. In view of the similarities between the processes, the reference numerals of FIG. 7 are utilized in FIG. 8. The method illustrated in FIG. 8 is particularly useful when it is desirable to avoid reducing the clearance below the girder 60 during the rehabilitating process.

It should particularly be noted that any combination of lifting, pulling, or pushing devices could be used to bend the girder 60 during the rehabilitating process. For example, sand boxes or various types of hydraulic devices could be employed.

Other modifications of the invention will be apparent to those skilled in the art in light of the foregoing description. This description is intended to provide specific examples of individual methods and embodiments which clearly disclose the present invention. Accordingly, the invention is not limited to these methods and embodiments or to the use of elements having specific configurations and shapes as presented herein. All alternative modifications and variations of the present invention which follow in the spirit and broad scope of the appended claims are included.

I claim:

1. A method for rehabilitating a ferroconcrete bridge girder having a concrete layer and a steel beam, the steel beam having a center region and the girder being attached at its ends to attachment points, the method comprising the steps of:

(a) positioning a crane lifting apparatus proximate the center region of the steel beam;

(b) operatively attaching the lifting apparatus to the center region of the steel beam;

(c) lifting the girder by operating the lifting apparatus, thereby bending the steel beam and causing the concrete layer to crack;

(d) removing the cracked concrete layer from the steel beam;

(e) adding shear connectors to the steel beam;

(f) casting a new layer of concrete on the steel beam, with the steel beam remaining bent while the new layer of concrete is cast thereon;

(g) curing a new layer of concrete to the point that it can absorb compressive stresses created by the steel beam; and (h) removing the lifting apparatus from out of contact with the steel beam, thereby causing the steel beam to no longer remain bent after the lifting apparatus is removed, wherein the rehabilitated bridge girder is prestressed and can carry greater loads than the former girder.

2. The rehabilitation method of claim 1, wherein the lifting apparatus is a crane.

3. A method for rehabilitating a ferroconcrete bridge girder having a concrete layer and a steel beam, the steel beam having a center region and the girder being attached at its end to attachment points the method comprising the steps of:

(a) positioning a lifting apparatus proximate the center region of the steel beam;

(b) operatively attaching the lifting apparatus to the center region of the steel beam;

(c) lifting the girder by operating the lifting apparatus, thereby bending the steel beam and causing the concrete layer to crack;

(d) adding shear connectors to the steel beam;

(e) filling the cracks in the concrete layer with a high-strength concrete, with the steel beam remaining bent during said filling;

(f) curing the high-strength concrete in the cracks to the point that it can absorb compressive stresses created by the steel beam and the concrete layer; and (g) removing the lifting apparatus from out of contact with the steel beam, thereby causing the steel beam to no longer remain bent after the lifting apparatus is removed, wherein the rehabilitated bridge girder is prestressed and can carry greater loads than the former girder.

4. The rehabilitation method of claim 2, wherein the lifting apparatus is a crane.

5. A method of rehabilitating a ferroconcrete bridge girder having a concrete layer having a steel beam, a middle region and two ends, the girder being attached at its ends to attachment points, the method comprising the steps of:

(a) positioning a dummy beam having a middle region and two ends beneath the girder;
(b) attaching the ends of the dummy beam to the ends of the steel beam;
(c) placing a pushing apparatus between the middle regions of the dummy beam and the steel beam;
(d) forcing the middle regions apart by means of the pushing apparatus, thereby putting the dummy beam and the steel beam in a bent configuration and thereby causing the concrete layer to crack;
(e) removing the concrete layer from the steel beam;
(f) adding shear connectors to the steel beam;
(g) casting a new layer of concrete on the steel beam, with the steel beam remaining bent while the new layer of concrete is cast thereon;
(h) curing the new layer of concrete to the point that it can absorb compressive stresses created by the steel beam; and
(i) removing the pushing apparatus and disengaging the ends of the steel and dummy beams, thereby causing the steel beam to no longer remain bent after removal of the pushing apparatus, wherein the rehabilitated bridge girder is prestressed and can carry greater loads than the former girder.

6. The method of claim 5, further comprising attaching the ends of the beams through the use of threaded rods, and wherein the pushing apparatus is a jack.

7. The method of claim 6, further comprising attaching a high-strength plate to the steel beam to assist the concrete in maintaining the steel beam's prestress.

8. The method of claim 7, wherein the high-strength plate comprises a graphite-reinforced epoxy.

9. A method of rehabilitating a ferroconcrete bridge girder having a concrete layer having a steel beam, a middle region and two ends, the girder being attached at its ends to attachment points, the method comprising the steps of:
(a) positioning a dummy beam having a middle region and two ends beneath the girder;
(b) attaching the ends of the dummy beam to the ends of the steel beam;
(c) placing a pushing apparatus between the middle regions of the dummy beam and the steel beam;
(d) forcing the middle regions apart by means of the pushing apparatus, thereby putting the dummy beam and the steel beam in a bent configuration and thereby causing the concrete layer to crack;
(e) adding shear connectors to the steel beam;
(f) filling the cracks in the concrete layer with a high-strength concrete, with the steel beam remaining bent during said filling;
(g) curing the high-strength concrete in the cracks to the point that it can absorb compressive stresses created by the steel beam and the concrete layer; and
(h) removing the pushing apparatus and disengaging the ends of the steel and dummy beams, thereby causing the steel beam to no longer remain bent after removal of the pushing apparatus wherein the rehabilitated bridge girder is prestressed and can carry greater loads than the former girder.

10. The method of claim 9, further comprising attaching the ends of the beams through the use of threaded rods, and wherein the pushing apparatus is a jack.

11. The method of claim 10, further comprising attaching a high-strength plate to the steel beam to assist the concrete in maintaining the steel beam's prestress.

12. The method of claim 11, wherein the high-strength plate comprises a graphite-reinforced epoxy.

13. A method of rehabilitating a ferroconcrete bridge girder having a concrete layer having a steel beam, a middle region and two ends, the girder being attached at its ends to attachment points, the method comprising the steps of:
(a) positioning a dummy beam having a middle region and two ends above the girder;
(b) attaching the middle region of the steel beam to the middle region of the dummy beam;
(c) placing a pair of pushing apparatus between the associated ends of the beams;
(d) forcing the ends of the beams apart by means of the pushing apparatus, thereby bending the beams and thereby causing the concrete layer to crack;
(e) removing the concrete layer from the steel beam;
(f) adding shear connectors to the steel beam;
(g) casting a new layer of concrete on the steel beam, with the steel beam remaining in a bent condition during said casting;
(h) curing the new layer of concrete to the point that it can absorb compressive stresses created by the steel beam; and
(i) removing the pair of pushing apparatus and disengaging the middle regions of the beams, thereby causing the steel beam to no longer remain bent after the pair of pushing apparatus are removed, wherein the rehabilitated bridge girder is prestressed and can carry greater loads than the former girder.

14. The method of claim 13, further comprising attaching the middle regions through the use of a threaded rod, and wherein the pushing apparatus are jacks.

15. The method of claim 14, further comprising attaching a high-strength plate to the steel beam to assist the concrete in maintaining the steel beam's prestress.

16. The method of claim 15, wherein the high-strength plate comprises a graphite-reinforced epoxy.

17. A method for rehabilitating a ferroconcrete bridge girder having a concrete layer having a steel beam, a middle region and two ends, the girder being attached at its ends to attachment points, the method comprising the steps of:
(a) positioning a dummy beam having a middle region and two ends above the girder;
(b) attaching the middle region of the steel beam to the middle region of the dummy beam;
(c) placing a pair of pushing apparatus between the associated ends of the beams;
(d) forcing the ends of the beam apart by means of the pushing apparatus, thereby causing both beams to bend and causing the concrete layer to crack;
(e) adding shear connectors to the steel beam;
(f) filling the cracks in the concrete layer with a high-strength concrete, with the steel beam remaining in a bent condition during said filling;
(g) curing the high-strength concrete in the cracks to the point that it can absorb compressive stresses created by the steel beam and the concrete layer; and
(h) removing the pair of pushing apparatus and disengaging the middle regions of the beams, thereby causing the steel beam to no longer remain bent after the pushing apparatus are removed, wherein the rehabilitated bridge girder is prestressed and can carry greater loads than the former girder.

18. The method of claim 17, further comprising attaching the middle regions through the use of a threaded rod and, wherein the pushing apparatus are jacks.

19. The method of claim 18, further comprising attaching a high-strength plate to the steel beam to assist the concrete in maintaining the steel beam's prestress.

20. The method of claim 19, wherein the high-strength plate comprises a graphite-reinforced epoxy.

* * * * *